US005989344A

United States Patent [19]

Platsch

[11] Patent Number: 5,989,344

[45] Date of Patent: Nov. 23, 1999

[54] ATOMIZER HEAD FOR LIQUIDS AND A DEVICE FOR SPRAYING WORKPIECES WITH LIQUIDS USING ATOMIZER HEADS OF SAID TYPE

[75] Inventor: Hans Platsch, Stuttgart, Germany

[73] Assignee: Klaschka GmbH + Co., Germany; a part interest

[21] Appl. No.: 08/875,567

[22] PCT Filed: Nov. 26, 1996

[86] PCT No.: PCT/EP96/05228

§ 371 Date: Jul. 25, 1997

§ 102(e) Date: Jul. 25, 1997

[87] PCT Pub. No.: WO97/19757

PCT Pub. Date: Jun. 5, 1997

[30] Foreign Application Priority Data

Nov. 27, 1995 [DE] Germany ..... 195 44 016

[51] Int. Cl.[6] ..... B05C 11/00; B05B 7/08

[52] U.S. Cl. ..... 118/684; 118/316; 118/314; 118/315; 239/296; 239/297

[58] Field of Search ..... 239/128, 133, 239/135, 139, 290, 296, 297, 300, 291, 292, 338, 311; 118/684, 676, 677, 600, 313, 314, 315, 316

[56] References Cited

U.S. PATENT DOCUMENTS

| | | | |
|---|---|---|---|
| 1,369,520 | 2/1921 | Day . | |
| 1,474,324 | 11/1923 | Holton . | |
| 1,609,465 | 12/1926 | Day . | |
| 2,152,767 | 4/1939 | McKnight | 299/140.1 |
| 2,401,503 | 6/1946 | Paasche | 299/140 |
| 2,976,329 | 3/1961 | Wabnitz | 219/39 |
| 3,168,250 | 2/1965 | Paasche | 239/300 |
| 4,370,994 | 2/1983 | Nagata et al. | 239/133 |
| 4,531,675 | 7/1985 | Muck . | |
| 4,852,773 | 8/1989 | Standlick et al. . | |
| 5,135,172 | 8/1992 | Toth . | |
| 5,180,104 | 1/1993 | Mellette . | |
| 5,344,078 | 9/1994 | Fritz et al. . | |
| 5,419,491 | 5/1995 | Breitsprecher | 239/296 |
| 5,577,666 | 11/1996 | Shen | 239/290 |

FOREIGN PATENT DOCUMENTS

| | | |
|---|---|---|
| 0 225 624 A2 | 6/1987 | European Pat. Off. . |
| WO 81/01670 | 6/1981 | WIPO . |

*Primary Examiner*—David A. Simmons
*Assistant Examiner*—Calvin Padgett

[57] ABSTRACT

In an atomizer head that produces a conical droplet mist, two shaping air ducts are diametrically opposing and are provided in the vicinity of the mist outlet aperture. The shaping air jets emerging from these ducts flatten the droplet mist which thus has a larger cone angle in one direction and a smaller cone angle in the other direction. A droplet mist thus flattened can be used to apply a liquid layer in a manner particularly true to the areas and contours of a workpiece surface.

18 Claims, 8 Drawing Sheets

ATOMIZER HEAD FOR LIQUIDS AND A DEVICE FOR SPRAYING WORKPIECES WITH LIQUIDS USING ATOMIZER HEADS OF SAID TYPE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

This application is a 371 of PCT/EP96/05228, filed Nov. 26, 1996.

Field of the Invention

The invention relates to an atomizing head and to a device for spraying workpieces with liquids by using such atomizing heads.

Atomizing heads of the type are found in diverse forms by way of atomizing heads in commercially available spray guns.

Atomizing heads of this type generally produce an axially symmetrical cone of droplets having a predetermined apex angle. If it is desired, with the aid of atomizing heads of this type, to spray workpieces with a liquid within a precisely predetermined edge contour, which is often rectangular or polygonal, the apex angle of the cone of droplets has to be chosen to be small and the surface to be sprayed has to be traversed with a propelled atomizing head, a procedure which is time-consuming and which in the case of automation necessitates a high degree of effort for a coordinate drive of the atomizing head and the control thereof. If working is effected with a relatively large number of atomizing heads that are distributed in accordance with the surface region to be covered, then in view of the costs of an atomizing head and the installation associated with it this again represents a considerable effort. In addition, the readjustment of an appropriate arrangement of fixed atomizing heads from one surface geometry to be sprayed to another is associated with many mechanical alterations and a great deal of time.

SUMMARY OF THE INVENTION

The object of the invention is to provide a device that improves spraying workpiece surfaces.

It has now been discovered that, in many cases, the spraying of partial regions of workpiece surfaces having rectangular or polygonal edge contours can be simplified by making use of nozzle heads that generate a cone of droplets having a non-circular cross-section. Cross-sections of this type are, for example, narrow rectangles. With such cross-sections of the cone of droplets it is possible for workpieces which are propelled in front of a atomizing head or a series of atomizing heads to be sprayed in very precise manner.

In order to obtain this advantage, an atomizing head according to the invention has, in addition to the nozzle device that atomizes the liquid, a droplet-cone forming-nozzle device is provided which directs jets of air against the cone of droplets which at first is axially symmetrical and in this way imparts polygonal cross-sectional shape to the latter, in particular widens it by pressure so as to form a flat rectangular cone.

An atomizing head having an advantageous feature of the invention, wherein the forming-air nozzle assembly comprises two forming-air channels that are located opposite one another with respect to the axis of the dosing aperture generates a cone of droplets having a transverse cross-section corresponding to a narrow rectangle, the narrow sides of which are constituted by small semicircles. In other words: by means of the control-nozzle device the cone of droplets is pressed flat, as a result of which its dimension is reduced in one direction and increased in the other direction.

In the case of an atomizing head having an advantageous feature of the invention, wherein the forming-air nozzle assembly comprises at least two sets of forming-air nozzles that are connected independently of one another to the source of forming air or to different sources of forming air the cone of droplets generated by the atomizing-nozzle device can also be flattened asymmetrically.

In the case of an atomizing head having an advantageous feature of the invention, wherein atomizing-air connection means in the housing to be connected to the source of atomizing air is connected to a working volume of a compressed-air servomotor, a drive part of which operates on the dosing needle, together with the application of pressure by means of atomizing air, the supply of liquid to the atomizing-nozzle device is also switched on at the same time.

The further development of the invention as set forth in claim 8 permits the throughput of liquid through the atomizing-nozzle device to be predetermined precisely in simple manner.

In the case of an atomizing head having an advantageous feature of the invention, comprising a servomotor that operates on the adjustable abutment the throughput of liquid can be set from an external control unit.

An atomizing head as set forth in claim 10 is particularly well suited for the atomizing of highly viscous liquids.

In the case of a device for spraying workpieces according to the invention the atomizing heads are switched on and off as a function of the position of the workpiece with respect to the atomizing-head arrangement.

In the case of an advantageous feature of the invention, comprising a plurality of atomizing heads, wherein the control unit comprises a memory that is addressed in accordance with the output signal of the position sensor and in memory cells of which those of the atomizing heads are stored that are to be triggered at the actual relative position of the workpiece with respect to the atomizing heads, spraying of the workpiece surfaces which, in desired manner, is only partial is obtained in simple manner.

With the further development of the invention wherein the control unit triggers a pressure-adjusting valve as a function of the feed rate of the workpiece in order to keep constant the amount of liquid applied onto the workpiece per unit area it is ensured that the amount of liquid applied onto the surface of the workpiece per unit area is independent of the speed at which the workpiece is propelled past the atomizing-head arrangement.

In this connection, in the case of an advantageous feature of the invention, wherein the control unit triggers the atomizing heads via a controllable phase member, the phase of which is adjusted in proportion to the speed of the workpiece it is automatically taken into consideration that the cones of droplets emitted by the atomizing heads require a certain time interval in order to reach the surface of the workpiece.

The further development of the invention, comprising a heating device acting on the supplied liquid and comprising 2/2 bypass valves or pressure relief valves that are connected to the atomizing heads, respectively and via which quantities of non-atomized liquid are conducted into a return pipe is particularly suitable for spraying workpiece surfaces with highly viscous liquids. In this connection it is ensured that the viscosity of these liquids does not increase as a result of their cooling in the feed pipes that lead to the atomizing heads.

In the case of an advantageous feature of the invention, wherein the control unit triggers a forming-air pressure regulator as a function of the output signal of the position sensor it is also possible for the width of the cone of droplets emitted in each instance from the atomizing heads to be controlled as a function of the location of the workpiece in relation to the atomizing-head arrangement.

The further development of the invention comprising an attendant pipe-heating unit for liquid-feed pipes leading to the atomizing heads is also advantageous with regard to homogeneous spraying of a workpiece surface with a highly viscous liquid.

BRIEF DESCRIPTION OF THE DRAWINGS

The invention is elucidated in more detail below on the basis of examples of embodiments with reference to the drawing. In the latter.

DETAILED DESCRIPTION OF PREFERRED EMBODIMENTS

Figure 1:
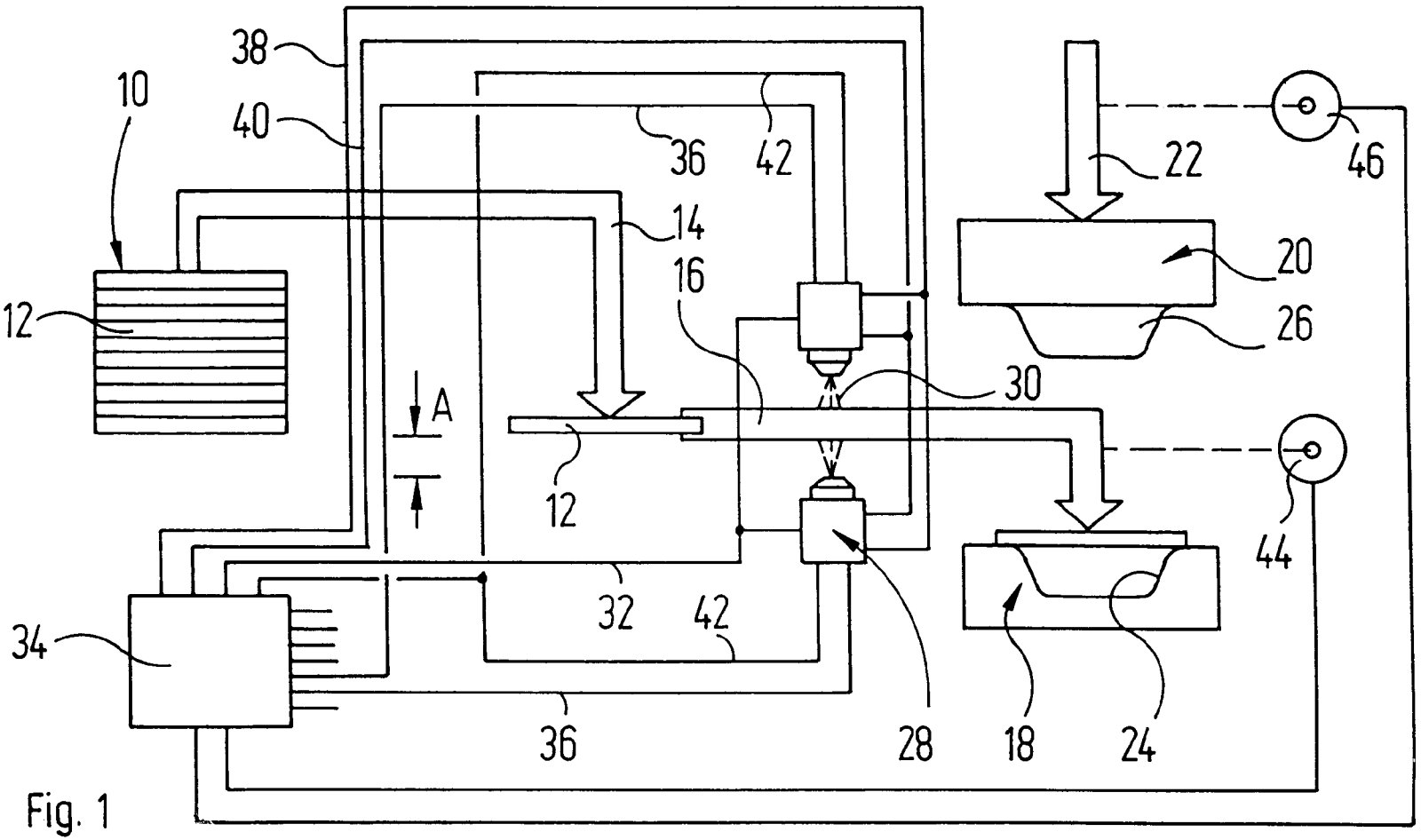
FIG. 1: shows a schematic block diagram of a production line for the deep-drawing of sheet-metal plates which is provided with a device for spraying selected surface sections of the sheet-metal plates.

Designated by 10 in FIG. 1 is a stack of individual sheet-metal plates 12. The sheet-metal plates 12 are brought into a waiting position by means of a first transport system 14 which is indicated only schematically. The sheet-metal plate located in the waiting position is placed by an additional transport system 16 onto a bottom flask 18 pertaining to a deep-drawing tool. A top flask 20 pertaining to the deep-drawing tool is moved by a compression drive 22 which is also indicated only schematically.

Upon deep-drawing of the sheet-metal plates 12 between bottom flask 18 and top flask 20 the various regions of the sheet-metal plate 12 are subjected to stress of varying intensity. The most deformation work has to be performed at the side walls of the trough-shaped recess 24 of the bottom flask 18 or of the complementary stamper section 26 of the top flask. In these regions the friction between the surfaces of the sheet-metal plates and the surfaces of bottom flask 18 and top flask 20 should be reduced through lubrication with a lubricating fluid having a high viscosity. In order to coat especially these intensely deformed plate regions with the lubricating fluid, above and below the track on which the sheet-metal plates 12 are propelled by the second transport system 16 atomizing heads 28 are arranged in a row perpendicular to the plane of the drawing. The latter emit in each instance a cone of droplets 30 consisting of small droplets of the highly viscous lubricant. The latter is supplied via a common lubricant feed pipe 32. The latter comes from a control/supply unit which is designated overall by 34. The various atomizing heads 28 furthermore have individual activation lines 36 which are connected to associated output terminals pertaining to the control/supply unit 34.

The atomizing heads 28 are furthermore connected to a common atomizing compressed-air pipe 38 and a common jet-forming compressed-air pipe 40. The various atomizing heads 28 are furthermore connected to a common heating-current line 42.

A first position sensor 44 cooperates with the second transport system 16, said first position sensor being shown in the form of a self-synchronous generator. From its output signal the control/supply unit 34 can detect, on the one hand, where a sheet-metal plate 12 to be sprayed is located at the present time with respect to the atomizing-head arrangement and can further detect at what speed the sheet-metal plate 12 is currently being put into operation.

A second position sensor 46 cooperates with the compression drive 22, the output signal of said second position sensor being utilised by the control/supply unit 34 for the purpose of detecting when the transport systems 14 and 16 have to be set in motion, said systems being likewise controlled by the control/supply unit 34.

Figure 2:
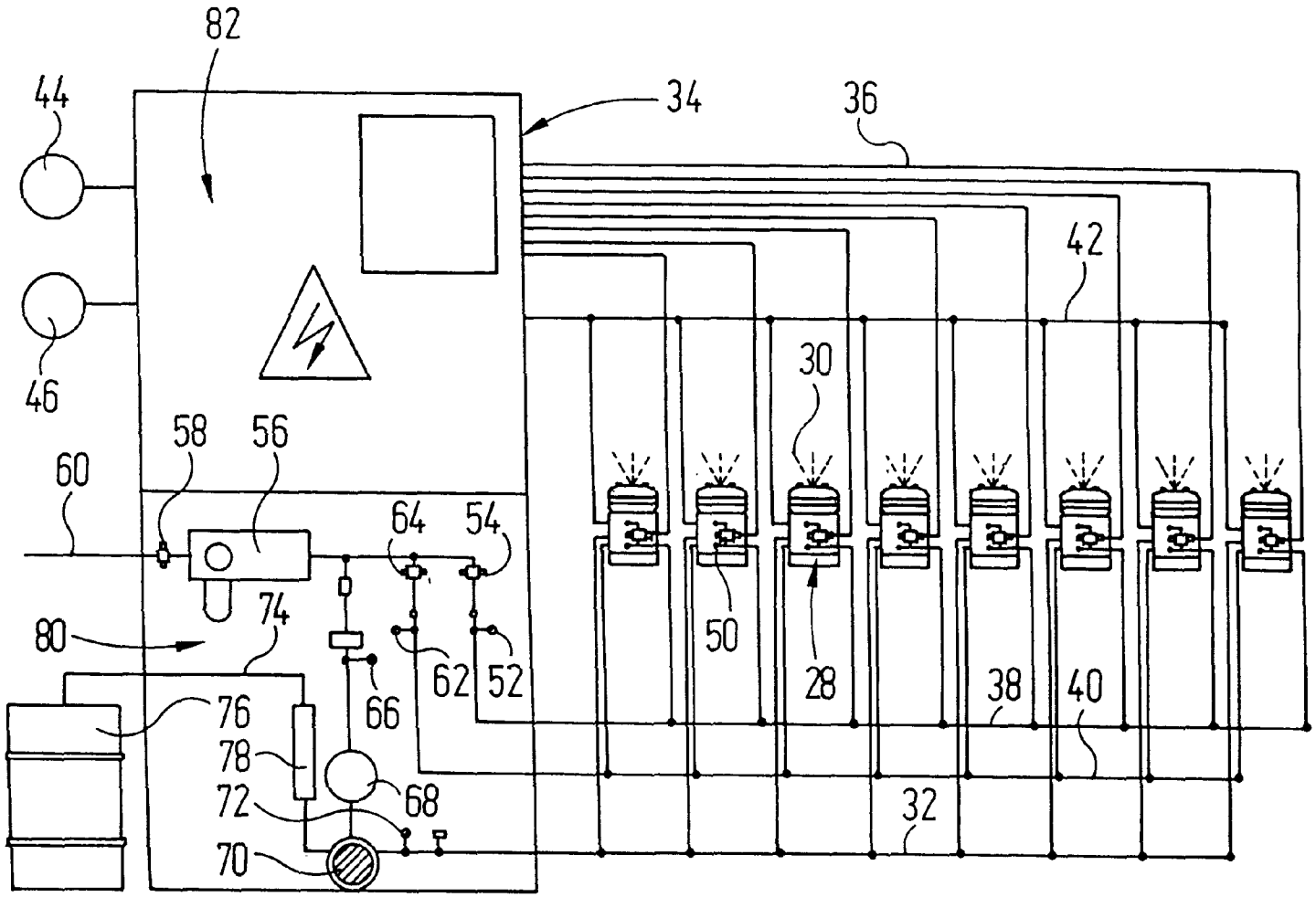
FIG. 2: shows a schematic representation of an atomizing-head arrangement pertaining to the device shown in FIG. 1 for spraying partial regions of the sheet-metal plates and of an associated control and supply unit.

In FIG. 2 parts of the device for spraying the sheet-metal plates such as have already been elucidated above with reference to FIG. 1 are provided once again with the same reference symbols.

Each of the activation lines 36 operates on a solenoid valve 50 which is built onto the atomizing head 28 under consideration, via which solenoid valve the atomizing air reaches the inside of the atomizing head. The atomizing-air compressed-air pipe 38 is connected via a pressure regulator 52 and a 2/2 solenoid valve 54 to the output of a cleaning unit 56, the input of which is connected via another 2/2 solenoid valve 58 constituting a main air valve to a compressed-air supply pipe 60.

The jet-forming compressed-air pipe 38 is connected via a second pressure regulator 62 and another 2/2 solenoid valve 64 to the output of the cleaning unit 56. Finally, the output of the cleaning unit 56 is connected via another pressure regulator 66 to a compressed-air motor 68 which operates on a diaphragm pump 70.

The outlet of the diaphragm pump 70 is connected via a pressure regulator 72 to the lubricant feed pipe 32. An electrical heater 78 is interpolated into a suction pipe 74 pertaining to the diaphragm pump 70 which leads to a storage container 76 for the lubricant.

The lubricant located in the storage container 76 is an emulsion of high viscosity similar to drilling milk. At room temperature it has approximately gel-like consistency (0.85 Pa.s). At the outlet of the heater 78 the lubricant is heated to about 50° C. and still has a viscosity of 0.4 Pa.s.

The parts of the system described above for supplying the atomizing heads with atomizing air, jet-forming air and lubricant together constitute the supply part of the control/supply unit 34 designated by 80. The control part of the control/supply unit 34 designated by 82 serves for feeding the heating elements that are assigned to the atomizing heads, for selective activation of the various atomizing heads 28, for triggering the various solenoid valves of the supply part 80 and for synchronising the temporal working window of the atomizing heads 28 and the amounts of liquid emitted by the latter as a function of the present location of the sheet-metal plate 12 being sprayed in the given instance in relation to the atomizing-head arrangement and also as a function of the speed of the sheet-metal plate 12, both of which can be derived from the output signal of the position sensor 44. On the basis of the output signal of the position sensor 46 the control part 82 is able to count the compression cycles. If desired, in this way it is possible for only every second, third, etc sheet-metal plate to be sprayed with lubricant if the deformation of the sheet-metal plate is only slight, so that lubricant left behind in the compression mould by a preceding sheet-metal plate still suffices for one, two or more subsequent sheet-metal plates.

In analogous manner, initial regions of a sheet-metal plate that are predetermined for each compression cycle can always be sprayed with lubricant, whereas less intensely deformed surface sections of the sheet-metal plate are only sprayed with lubricant in the case of each second, third, fourth, etc sheet-metal plate.

Figure 3:
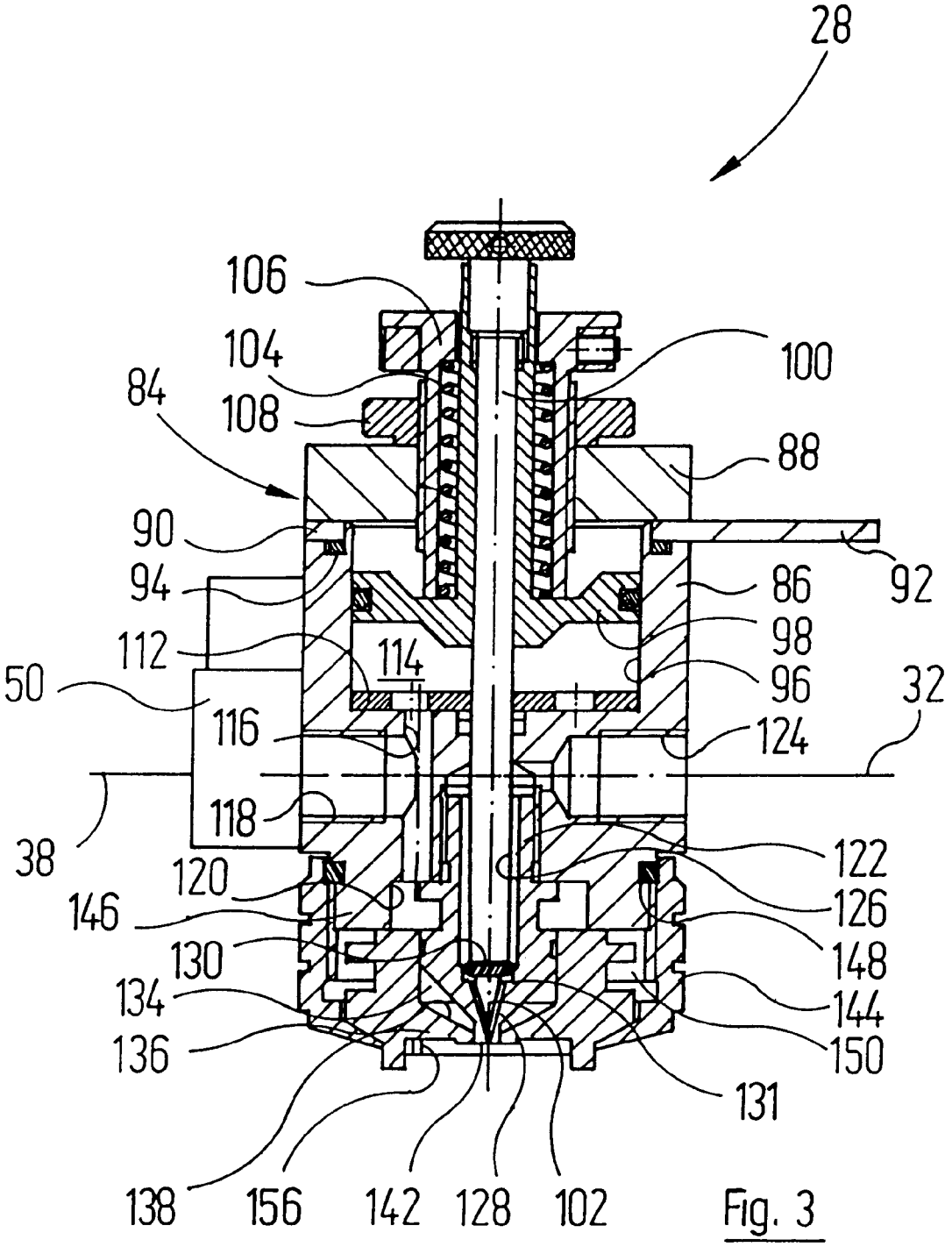
FIG. 3: shows an axial section through one of the atomizing heads that are reproduced in FIG. 2 in schematic form only.
Figure 4:
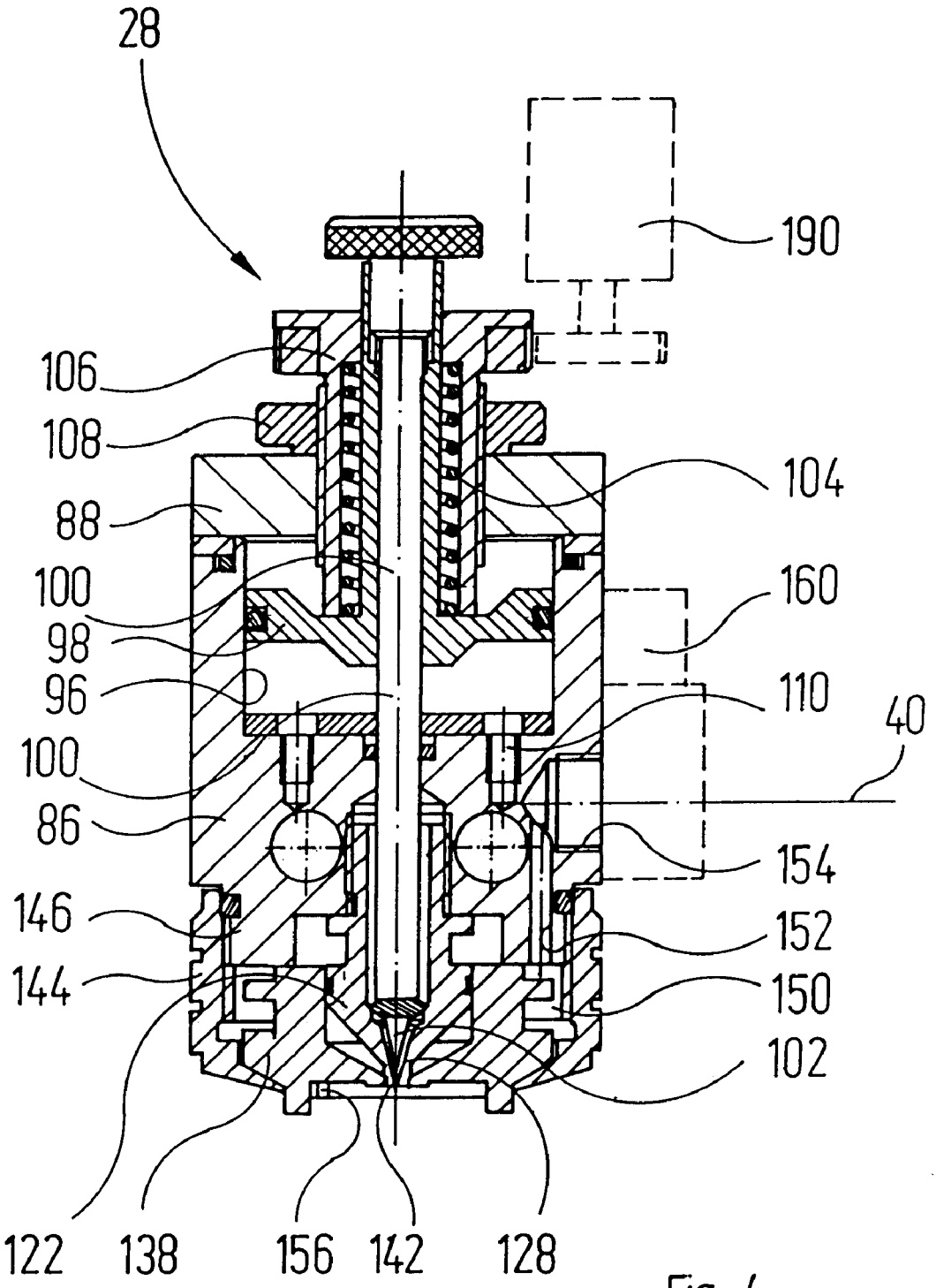
FIG. 4: shows an axial section through the atomizing head shown in FIG. 3 in an intersecting plane perpendicular to the plane of the drawing of FIG. 3.
Figure 5:
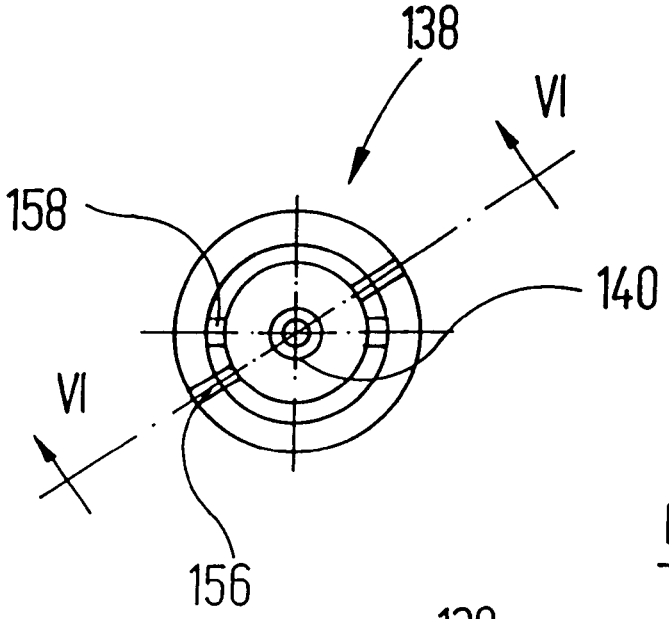
FIG. 5: shows an axial top view of the free end of a forming-air nozzle body of the atomizing head shown in FIGS. 3 and 4.
Figure 6:
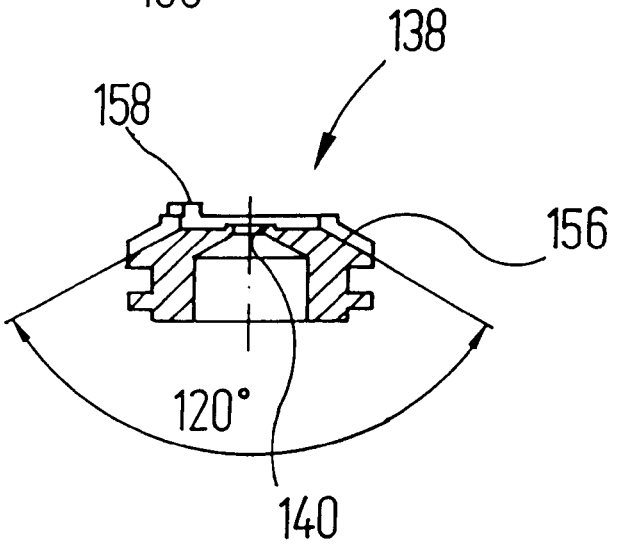
FIG. 6: shows an axial section through the forming-air nozzle body shown in FIG. 5, along the line of intersection VI—VI therein.
Figure 7:
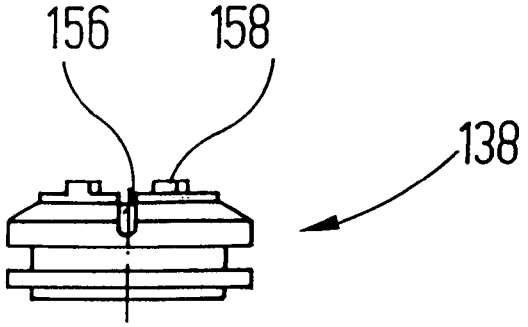
FIG. 7: shows a lateral view of the forming-air nozzle body in FIG. 6, viewed from the left.

In FIGS. 3 and 4 a housing of an atomizing head 28 is designated overall by 84. It has a main housing part 86 which is sealed at the top by a cover 88.

The main housing part 86 has at its upper end an annular shoulder 90 on which a retaining plate 92 rests, via which the atomizing head 28 is secured to a supporting structure (not shown). The retaining plate 92 is clamped in the manner of a sandwich between the cover 88 and the main housing part 86 and is sealed in relation to the inside of the housing by means of an O-ring 94.

In the main housing part 86 a cylindrical bore 96 is provided in which a piston 98 operates. The latter is firmly connected to a long dosing needle 100 which has a pointed conical control section 102.

The piston 98 is prestressed by a spring 104 in the downward direction in FIG. 3, said spring being received within a sheath-shaped spring chamber 106 which is borne by the cover 88 in a manner permitting it to be screwed. The lower front face of the sheath-shaped spring chamber 106 at the same time forms an abutment face which presets the upper dead point of the piston 98 in adjustable manner. With a view to securing the spring chamber 106 in the chosen axial position a threaded locking ring 108 is provided which runs along the outer thread of the spring chamber 106 and cooperates with the upper side of the cover 88. A damper plate 112 connected by screws 110 to the bottom of the cylindrical bore 96 prevents hard impacting of the piston 98 on the bottom of the cylindrical bore 96.

The working volume 114 delimited between the piston 98 and the cylindrical bore 96 is in communication with an atomizing-air connecting channel 118 via an axial bore 116 in the main housing part 86. The bore 116 extends beyond the connecting channel 118 and terminates in a counter-bore 120 which is sunk into the underside of the main housing part 86. From the counter-bore 120 a threaded bore extends upwards which is coaxial with the cylindrical bore 96 and into which an atomizing nozzle body 122 is screwed. The upper end of this threaded bore is in communication with a lubricant connecting channel 124.

The nozzle body 122 has a centric bore 126 which surrounds the dosing needle 100 subject to a spacing. In the conical lower end section of the nozzle body 122 a conical dosing aperture 128 is provided which has the same cone-apex angle as the control section 102 of the dosing needle 100. In the transitional region between its shaft section and the control section 102 the dosing needle 100 bears an O-ring 130 which enters into engagement with an end section 131 of reduced diameter pertaining to the bore 126 before the end section 102 strikes the dosing aperture 128, in order to be able to seal the dosing aperture 128 completely without a high surface pressure between the opposing surfaces of control section 102 and dosing aperture 128 being necessary.

Figure 8:
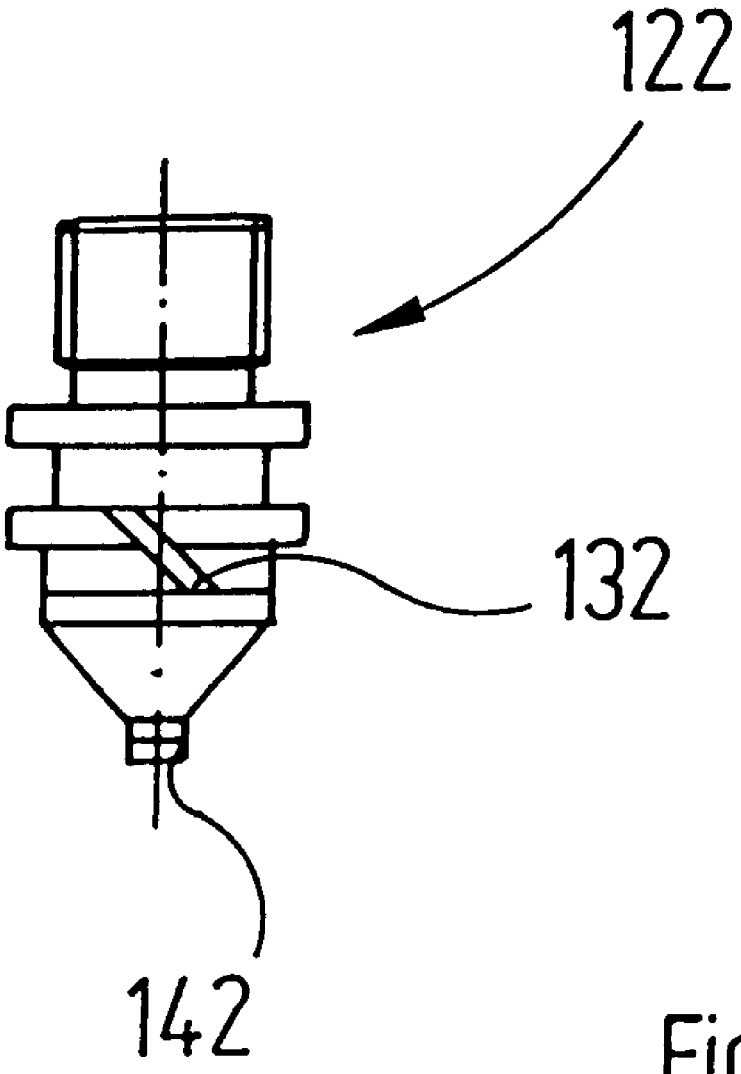
FIG. 8: shows a lateral view of an atomizing-air nozzle body pertaining to the atomizing head shown in FIGS. 2 and 4.

As is evident from FIG. 8, in the external peripheral surface of the nozzle body 122 two diametrically opposed nozzle grooves 132 are provided which exhibit a pitch of about 45° and connect the counter-bore 120 to a space 134 which is delimited between the conical lower front face of the nozzle body 122 and a cylindrical/conical counter-bore 136 which is provided in a jet-forming nozzle body 138 coaxially in relation to the atomizing nozzle body 122.

The space 134 is in communication with the environment via a centric aperture 140 in the lower wall of the nozzle body 138. Through the aperture 140 an end section 142 of the nozzle body 122 extends subject to a radial clearance.

The nozzle body 138 is arranged inside a mounting ring 144 which is screwed onto a threaded lower end section 146 of the main housing part 86 and is sealed in relation to the latter via an O-ring 148.

For its part, the mounting ring 144 delimits with the nozzle body 138 a space 150 which is in communication with a forming-air connecting aperture 154 via an axial channel 152 (cf FIG. 4).

As is evident from FIGS. 3–7, the nozzle body 138 has a conical lower front face, the apex angle of this conical surface amounting to about 120°. Inserted into the conical surface are two diametrically opposed forming-air nozzle grooves 156. Teeth 158 protruding from the front face of the nozzle body 138 serve to adjust a predetermined angular position of the nozzle grooves 156 with respect to the housing 84 that has a substantially square cross-section.

The atomizing head described above operates in the following way:

Normally the piston 98 assumes, under the force of the spring 104, its lower end position in which the dosing aperture 128 is sealed by the O-ring 130 borne by the dosing needle 100.

Upon pressurisation of the connecting channel 118 by triggering the associated solenoid valve 50 the piston 98 is moved upwards contrary to the force of the spring 104, so that the lubricant which is under pressure in the connecting channel 124 reaches the dosing aperture 128. At the same time compressed air is conducted, via the dosing grooves 132, into the space 134 and emitted through the aperture 140 which surrounds the emission end of the nozzle aperture 128. Consequently there emerges altogether from the aperture 140 a cone of droplets which, in the case of the viscosity of the lubricant described above, has an apex angle of about 28°.

At the same time, via the connecting aperture 154 and the nozzle grooves 156, additional compressed air reaches the front face of the nozzle body 138. The two opposing jets of compressed air emerging from the nozzle grooves 156 act on opposite lateral sections of the cone of droplets emerging from the aperture 140. By this means the cone is flattened and is given, instead of circular cross-section, the cross-section of a flat rectangle having rounded narrow sides. The apex angle of the cone of droplets that has been pressed flat amounts to about 50° measured in the direction of the major axis of the cross-section, less when measured in the direction of the minor axis in accordance with the rearrangement of the cross-section, namely about 15°.

By means of the deformed cone of droplets generated by the atomizing head an approximately ridge-shaped pattern of lubricant is obtained on a stationary workpiece. Upon movement of the workpiece an approximately rectangular pattern of lubricant on the surface of the workpiece is obtained.

As indicated by a dashed line in FIG. 4, it is also possible to provide solenoid valves 160 for the forming-air connecting apertures 154 so that the various atomizing heads can be controlled variably with respect to the cross-sectional shape of the cone of droplets emitted.

In order to keep the emitted quantity of lubricant independent of the rate of delivery of the sheet-metal plates 12, the pressure regulator 72 can be adjusted with respect to the control pressure so as to correspond to a sheet-metal-plate speed signal by means of the control part 82, the sheet-metal-plate speed signal being obtained by differentiating the output signal of the position sensor 44.

Alternatively, the quantity of liquid emitted by the atomizing heads 28 may be kept constant and, with a view to varying the application of lubricant on the surfaces of the workpiece, the delivery rate of the transport system 16 may be varied.

Figure 9:
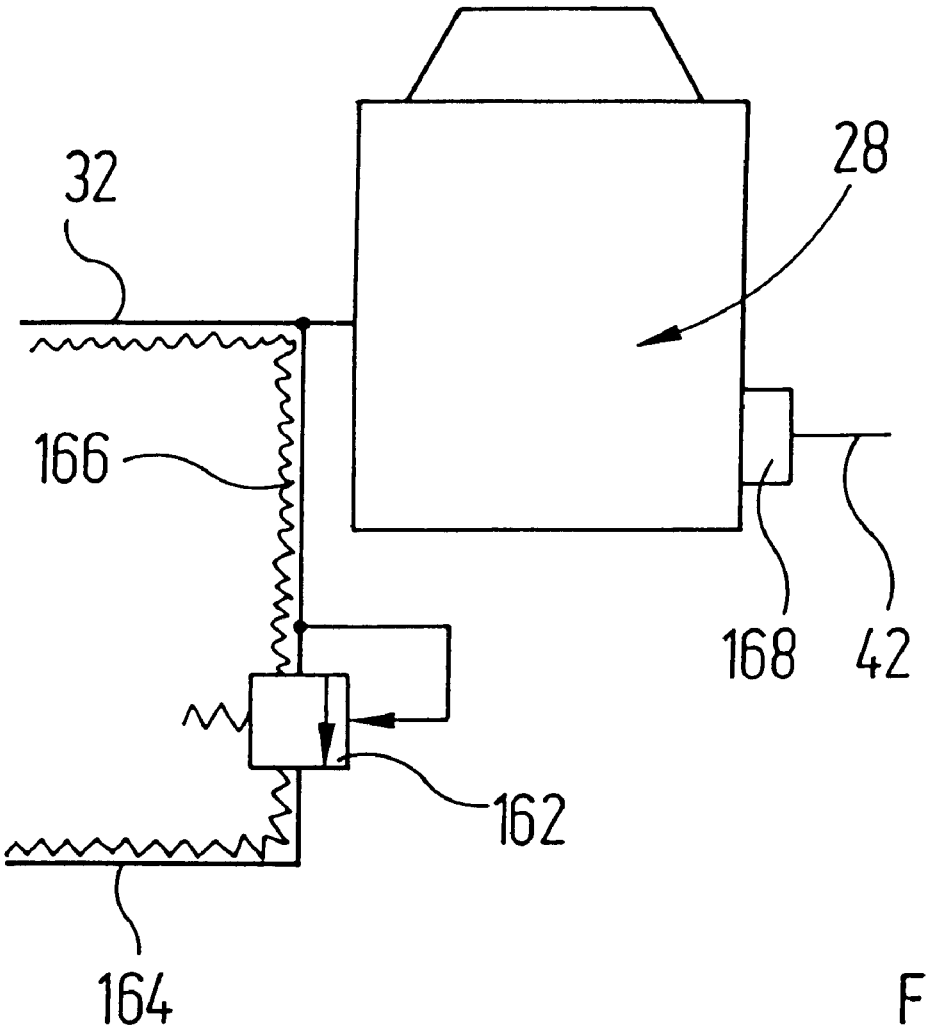
FIG. 9: shows a schematic representation of a modified atomizing head.

In order to prevent clogging of the lubricant pipes by lubricant becoming cold, as shown in FIG. 9 a constant basic stream of heated lubricant can be maintained by connecting the lubricant inlet of the atomizing heads to a return pipe 164, in each instance via a pressure relief valve 162.

Instead of this, at the lubricant inlet of the atomizing heads in each instance a 3/2 solenoid valve may also be provided which is reversed in push-pull relation to the solenoid valve 50 of the atomizing head in order to supply lubricant to the return pipe 164 when the dosing aperture 128 is closed but to the dosing aperture 128 when the dosing aperture is open.

Shown furthermore in FIG. 9 are an attendant pipe-heating unit 166 and a heating element 168 assigned to the housing of the atomizing head.

Figure 10:
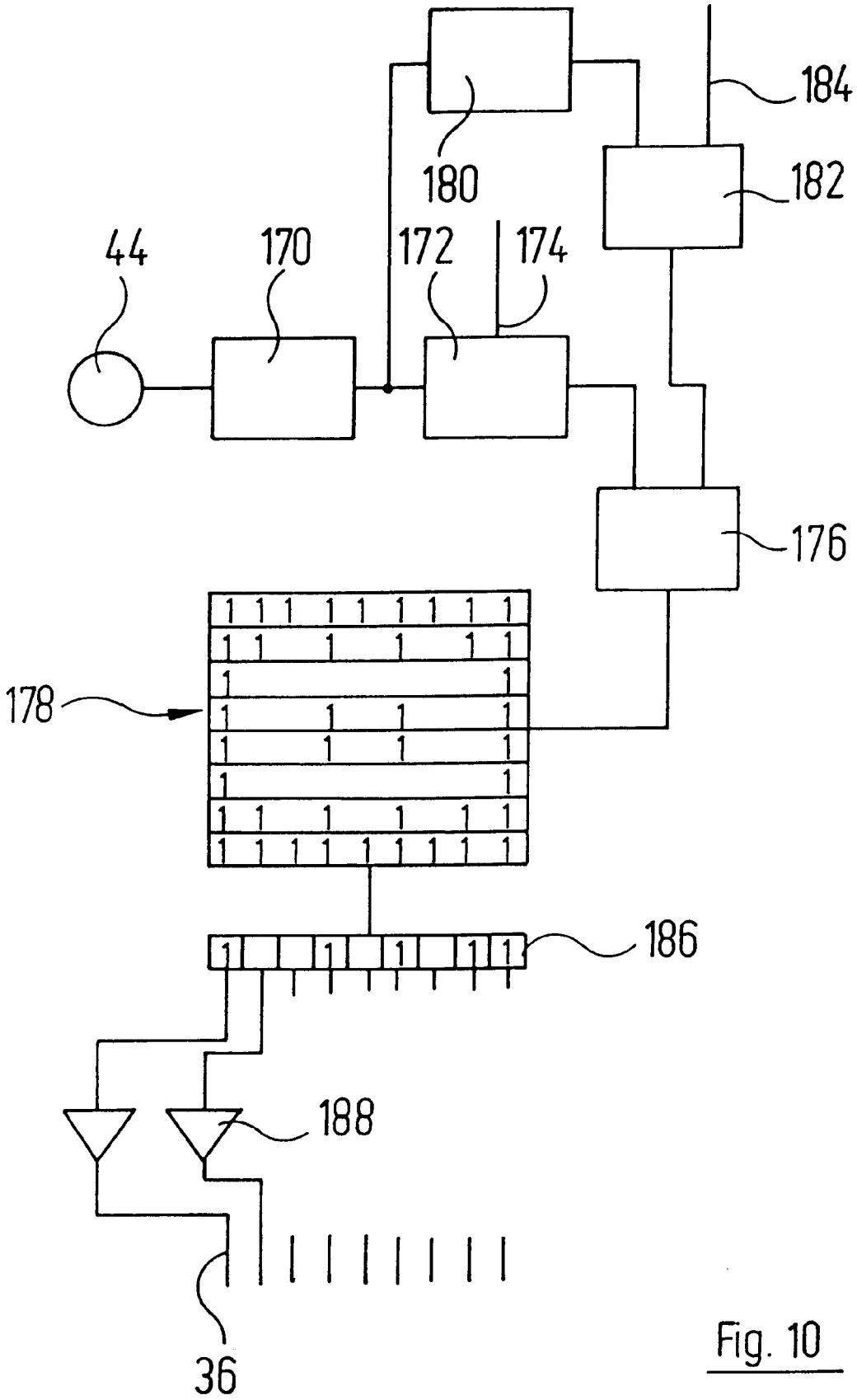
FIG. 10: shows the circuit diagram of a control circuit for the selective activation of atomizing heads as a function of the position of a workpiece.

FIG. 10 shows a control circuit for the purpose of activating the atomizing heads 28 as a function of the position, in relation to the atomizing heads, of the sheet-metal plate to be sprayed.

The output of the position sensor 44 is connected to the input of an analogue/digital converter 170. The output signal of said converter is rounded by a digital rounding circuit 172. The latter obtains, via a line 174, a digital signal corresponding to the desired rounding, said signal being a measure of the flattening of the cone of droplets 30 and being, for example, derived from the output signal of a pressure sensor (not shown) which is pressurised by the forming-air pressure.

In a summing circuit 176 a speed-dependent steering signal is added to the rounded path signal. The corrected path signal obtained in this way serves to address a memory 178, in the cells of which signal words are stored having a bit number corresponding to (or greater than) the number of atomizing heads to be triggered. A "1" bit stands for an atomizing head to be activated; a bit that is not set indicates that the associated atomizing head is not currently needed for generating the pattern of lubricant.

It will be appreciated that the bit pattern that has been entered into the memory 178 by way of example corresponds to a coating of the edge of a sheet-metal plate with accentuation of the corner regions and a weaker coating of the central regions of the plate.

With a view to generating the steering signal, the output of the A/D converter 170 is additionally connected to a digital differentiating circuit 180. The plate-speed signal obtained in this way is converted in a computing circuit 182 into the steering signal, in connection with which the computing circuit 182 receives, via a line 184, an additional signal corresponding to the speed of the droplets in the droplet cone. This additional signal may, for example, be derived from the output signal of a pressure sensor (not shown) which is pressurised by the pressure of the atomizing air.

The summing circuit 176 consequently constitutes, in effect, a controllable phase shifter or a controllable timing element for synchronising the working heads with the motion of the sheet-metal plates.

The word in the memory 178 selected by the output signal of the summing circuit is transferred to a register 186, the individual memory elements of which operate on the activation lines 36 via amplifiers 188.

In the case of the atomizing heads described above, the forming-air nozzle grooves 156 were both in communication with the annular space 150, so that the cone of droplets is flattened symmetrically. Instead of this, the two forming-air nozzle grooves may also be connected to separate housing connectors and may be connected to separate sources of forming air. In this way an asymmetric flattening of the cone is obtained. For this purpose the forming-air nozzle grooves may also be distributed asymmetrically about the axis of the aperture 140.

By increasing the number of forming-air nozzle grooves the cone of droplets may also be flattened several times so as to produce, for example, substantially square cross-sectional shape.

In the case of the atomizing heads described above, the adjustment of the atomizing rate was effected manually by screwing the spring chamber 106. Instead of this, with omission of the locking ring 108, the spring chamber may be screwed by means of a self-inhibiting transmission servomotor, as indicated in FIG. 4 by a dashed line at 190.

I claim:

1. A device for spraying a workpiece with a liquid, having at least one atomizing head (28), having a storage container (76) for a liquid to be atomized, having a pump (70) for delivering the liquid that is to be atomized from the storage container (76) to said at least one atomizing head (28), having an atomizing-air control-valve arrangement (50) connected between a source of atomizing-air (38) and atomizing-air connecting means (118) of said at least one atomizing head (28) and having a source of forming-air (40) connected to the forming-air connecting means (154) of said at least one atomizing head (28), wherein the control-valve arrangement (50) is activated by a control unit (82) responsive to an output signal of a path position sensor (44) responding to the position of the workpiece (12) to be sprayed, the workpiece (12) being propelled past said at least one atomizing head (28) by a transport device (16), and wherein said at least one atomizing head (28) includes a housing (84), an atomizing nozzle body (122) formed with a dosing aperture (128) and with said atomizing-air connecting means (118) as well as liquid connection means (124) connected to said storage container (76), includes a dosing needle (100) that is coaxial with the dosing aperture (128) and together with the latter defines a cross-section of a feed passage for the liquid to be atomized, includes an atomizing-air nozzle assembly (132) surrounding the dosing aperture (128), said atomizing nozzle assembly (132) communicating with said atomizing-air connection means (118) and providing an axially symmetrical stream of air, and includes a forming-air nozzle assembly (156) arranged around the atomizing nozzle assembly (132), the forming-air nozzle assembly (156) communicating with the forming-air connecting means (154) connected to the source of forming-air (40) and generating a stream of forming-air that is directed in such a way that it impinges on a cone of droplets (30) exhibiting a conical outer contour and generated by the nozzle body (122) and the atomizing nozzle assembly (132).

2. The device as set forth in claim 1, wherein the forming-air nozzle assembly (156) comprises two forming-air channels that are located opposite one another with respect to the axis of the dosing aperture (128).

3. The device as set forth in claim 2, wherein the forming-air channels (156) are located in an axial plane of the dosing aperture (128).

4. The device as set forth in claim 3, wherein the forming-air channels (156) extend obliquely in relation to an axis of the dosing aperture (128).

5. The device as set forth in claim 4, wherein an angle included between the forming-air channels (156) amounts to about 120°.

6. The device as set forth in claim 1, wherein the forming-air nozzle assembly (156) comprises at least two sets of forming-air nozzles that are connected independently of one another to the source of forming air (40) or to different sources of forming air.

7. The device as set forth in claim 1, wherein atomizing-air connection means (118) is connected to a working volume (114) of a compressed-air servomotor (96, 98), a drive part of which operates on the dosing needle (100).

8. The device as set forth in claim 1, comprising an adjustable abutment (106) defining an open position of the dosing needle (100).

9. The device as set forth in claim 8, comprising a servomotor that operates on the adjustable abutment (106).

10. The device as set forth in claim 1, wherein a heating element (168) is thermally coupled to the housing (84).

11. The device as set forth in claim 1, comprising a plurality of atomizing heads, wherein the control unit (82) comprises a memory (178) that is addressed in accordance with the output signal of the position sensor (44) and in memory cells of which those of the atomizing heads (28) are stored that are to be triggered, at the actual relative position of the workpiece (12) with respect to the atomizing heads (28).

12. The device as set forth in claim 11, wherein the control unit (82) triggers a pressure-adjusting valve (72) as a function of the feed rate of the workpiece (12) in order to keep constant the amount of liquid applied onto the workpiece per unit area.

13. The device as set forth in claim 11, wherein the control unit (82) triggers the atomizing heads (28) via a controllable phase member (176), the phase of which is adjusted in proportion to the speed of the workpiece.

14. The device as set forth in claim 1, comprising a heating device (78) acting on the supplied liquid and comprising 2/2 bypass valves or pressure relief valves (162) that are connected to the atomizing heads, respectively (28) and via which quantities of non-atomized liquid are conducted into a return pipe (164).

15. The device as set forth in claim 1, wherein the control unit (82) triggers a forming-air pressure regulator (62) as a function of the output signal of the position sensor (44).

16. The device as set forth in claim 1, comprising an attendant pipe-heating unit for liquid-feed pipes (32) leading to the atomizing heads (28).

17. The device as set forth in claim 1, wherein the cross-section of the liquid feed passage is adjustable.

18. The device as set forth in claim 1, wherein the axially symmetrical stream of air exhibits twist.

* * * * *